United States Patent [19]

Anderson et al.

[11] 4,372,053

[45] Feb. 8, 1983

[54] DRYER FOR PARTICULATE MATERIAL

[75] Inventors: Robert J. Anderson; Glenn E. Hall, both of Toledo, Ohio

[73] Assignee: The Andersons, Maumee, Ohio

[21] Appl. No.: 209,140

[22] Filed: Nov. 21, 1980

[51] Int. Cl.[3] ..... F26B 3/16; F26B 17/14

[52] U.S. Cl. ..... 34/11; 34/43; 34/56; 34/65; 34/102; 34/170

[58] Field of Search ..... 34/64, 65, 170, 175, 34/102, 56, 43, 11

[56] References Cited

U.S. PATENT DOCUMENTS

| | | | |
|---|---|---|---|
| 63,374 | 4/1867 | Engels et al. | 34/33 |
| 128,707 | 7/1872 | Card . | |
| 563,801 | 7/1896 | Ramos | 34/11 |
| 915,534 | 3/1909 | Arnold . | |
| 1,058,291 | 4/1913 | Dennis . | |
| 1,100,397 | 6/1914 | Reynolds . | |
| 1,157,935 | 10/1915 | Gray | 426/302 |
| 1,308,942 | 7/1919 | French | 34/11 |
| 1,528,696 | 3/1925 | Robinson . | |
| 1,791,054 | 2/1931 | Dalton | 34/10 |
| 1,863,803 | 6/1932 | Patenburg . | |
| 1,926,215 | 9/1933 | Stou et al. | 34/64 |
| 2,073,553 | 3/1937 | Deinst . | |
| 2,333,089 | 11/1943 | Burkhardt . | |
| 2,636,575 | 4/1953 | Watson . | |
| 2,701,920 | 2/1955 | Campbell . | |
| 2,706,343 | 4/1955 | Oholm . | |
| 3,257,733 | 6/1966 | Lues et al . | |
| 3,300,873 | 1/1967 | Bussell et al. | 34/168 |
| 3,302,297 | 2/1967 | Graham | 34/65 |
| 3,373,503 | 3/1968 | Kline et al. . | |
| 3,440,734 | 4/1969 | Batterton et al. . | |
| 3,538,612 | 11/1970 | Groth et al. | 34/11 |
| 3,553,846 | 1/1971 | McKenzie et al. . | |
| 3,615,723 | 10/1971 | Meade | 426/294 |
| 3,645,006 | 2/1972 | Anderson | 34/22 |
| 3,701,203 | 10/1972 | Anderson | 34/170 |
| 3,710,449 | 1/1973 | Rathbun . | |
| 3,792,536 | 2/1974 | McGehee | 34/102 |
| 3,861,054 | 1/1975 | Stahl . | |
| 3,869,809 | 3/1975 | Keirn . | |
| 3,982,329 | 9/1976 | Dougherty . | |
| 4,006,536 | 2/1977 | Meiners | 34/169 |
| 4,020,561 | 5/1977 | Mathews . | |
| 4,125,945 | 11/1978 | Westlaken | 34/65 |

*Primary Examiner*—Larry I. Schwartz
*Attorney, Agent, or Firm*—Emch, Schaffer & Schaub

[57] ABSTRACT

This invention relates to a method and apparatus for drying particulate material wherein the particulate material is passed through an enclosed chamber. A heated fluid is introduced into a portion of the enclosed chamber to heat and absorb the moisture from the particulate material. A cooling fluid is introduced into a portion of the enclosed chamber to cool and absorb moisture from the heated particulate material. The particulate material is recirculated through the enclosed chamber until the desired degree of drying is achieved.

30 Claims, 4 Drawing Figures

DRYER FOR PARTICULATE MATERIAL

BACKGROUND OF THE INVENTION

This invention pertains to a Method and Apparatus for drying or removing moisture from particulate material. In one of its more specific aspects, the present invention relates to circulating the particulate material through heating and cooling zones until the desired dryness or moisture content is achieved. In this specific aspect hot air is caused to move with the particulate material through the heating zone and cool air is caused to move against the flow of the particulate material in the cooling zone. The circulation rate of the particulate material through the dryer and the cooling zone air flow rate can be varied to control the particulate material drying rate and temperature, as well as to control the ratio of moisture removal from the particulate material in the heating and cooling zones.

At present, a number of particulate materials, including most grains, must be dried prior to storage. In the case of grains the final moisture in the dried grain should be controlled and the moisture content should be relatively uniform throughout the grain that is to be stored. Accordingly, a number of drying systems have been devised to dry particulate material.

One of the prior art grain dryers that has been used can be generally referred to as a crossflow dryer. In this dryer particulate material is caused to flow between two perforated walls and hot air is forced through the particulate material in a direction which is approximately perpendicular to the direction of flow of the particulate material. As the hot air passes through the particulate material, the particulate material is dried. In some dryers of this type cool air is passed through the particulate material in the bottom of the dryer and the cool air also travels in a direction which is approximately perpendicular to the direction of flow of the particulate material. In the crossflow dryer the particulate material generally passes through the dryer only once, and it can be difficult to achieve the desired amount of drying in one pass of the particulate material through the dryer and, at the same time maintain an acceptable quality level. Also, the grain temperature in the crossflow dryer approaches the temperature of the drying air and, accordingly, the temperature of the drying air must be limited to prevent excessive particulate material temperatures. Thus, relatively inefficient low temperature air must be used to dry the particulate material in a crossflow type of dryer. Another limitation of the crossflow dryer is that there is very little mixing of the particulate material as it passes through the dryer. The hot air is introduced on one side of the dryer and caused to flow through the particulate material in a direction that is generally perpendicular to the direction of flow of the particulate material. The particulate material is exposed to higher temperature air on one side of the dryer, where the drying air is introduced, and lower temperature air on the other side of the dryer, where the drying air is removed. Therefore, it is very difficult to achieve uniform drying with this type of dryer. It should also be noted that since relatively low temperature drying air is used in this type of dryer that large quantities of air must be forced through the particulate material to achieve the desired dryness.

Another type of prior art grain dryer is the concurrent flow heating-counter flow cooling dryer. In this dryer heated air is introduced into the particulate material in the upper region of the dryer where the heated air flows in the same general direction as the particulate material. The heated air is then exhausted from the particulate material in the central region of the dryer. Cooling air is introduced at the bottom of the dryer and travels in a direction generally counter to the direction of flow of the particulate material. The cool air is also exhausted from the dryer in the central region of the dryer. The heated air and cooling air are normally removed from the dryer at a common exhaust. U.S. Pat. Nos. 3,710,449 and 3,701,203 disclose dryers that can generally be categorized as concurrent flow heating-counter flow cooling dryers. A major disadvantage with the above type of dryer is that the particulate material passes through the dryer only once and, accordingly, the particulate material must be exposed to the hot air for a relatively long period of time to achieve the desired final moisture content. Since the particulate material is exposed to the hot air for a long period of time the particulate material will undergo a significant increase in temperature. Therefore, the temperature of the heated air must be limited to prevent degradation of the particulate material that is being dried. Limiting the temperature of the heated air reduces the potential drying efficiency and also requires larger quantities of air to be forced through the particulate material to achieve the desired amount of drying. In this type of dryer the moisture is removed from the particulate material in one pass through the dryer. Accordingly, the moisture must be removed from the particulate material relatively rapidly as the particulate material passes through the dryer. The relatively rapid removal of the mositure can be detrimental to the physical properties of the particulate material.

According to the invention, there is provided apparatus for drying particulate material comprising an enclosed chamber through which the particulate material is passed. A heating zone in the chamber is adapted for the introduction of a heated fluid therein, the heated fluid is introduced to travel in the same direction as the particulate material through the heating zone to heat and remove moisture from the particulate material. A cooling zone in the chamber is adapted for the introduction of cooling fluid therein, the cooling fluid is introduced to travel in a direction opposite to the direction of travel of the heated particulate material through the cooling zone to cool and remove moisture from the particulate material. Means is provided to recirculate the particulate material through the enclosed chamber until the desired degree of drying is achieved.

There is also provided, according to the invention, a method for drying particulate material comprising passing the particulate material through an enclosed chamber. A heated fluid is introduced into a portion of the enclosed chamber to heat and absorb moisture from the particulate material, the heated fluid travels in the same direction as the particulate material through the enclosed chamber. A cooling fluid is introduced into a portion of the enclosed chamber to cool and absorb moisture from the heated particulate material, the cooling fluid travels in a direction opposite to the direction of travel of the particulate material through the enclosed chamber. The particulate material is recirculated through the enclosed chamber until the desired degree of drying is achieved.

The invention can be used to dry almost any particulate material. The invention is particularly useful, however, in drying grain and other agricultural products. Accordingly, in the description of the invention there will be some reference to specific applications involving agricultural products. However, it should be understood that the invention can be used to dry other particulate material.

It is an object of the invention to provide improved method and apparatus for drying particulate material which will result in the following advantages: (1) improved fuel economy; (2) improved product quality; (3) reduced fire hazard; (4) minimized air pollution; (5) stabilized fuel efficiency over extremely wide drying ranges and operating conditions; (6) improved drying efficiency at lower moisture contents; and (7) achievement of substantially the desired final moisture content in dried particulate material.

It is a further object of the invention to provide improved method and apparatus wherein the particulate material is recirculated through a drying chamber until the desired degree of dryness is achieved.

DESCRIPTION OF THE PREFERRED EMBODIMENT

Figure 1:
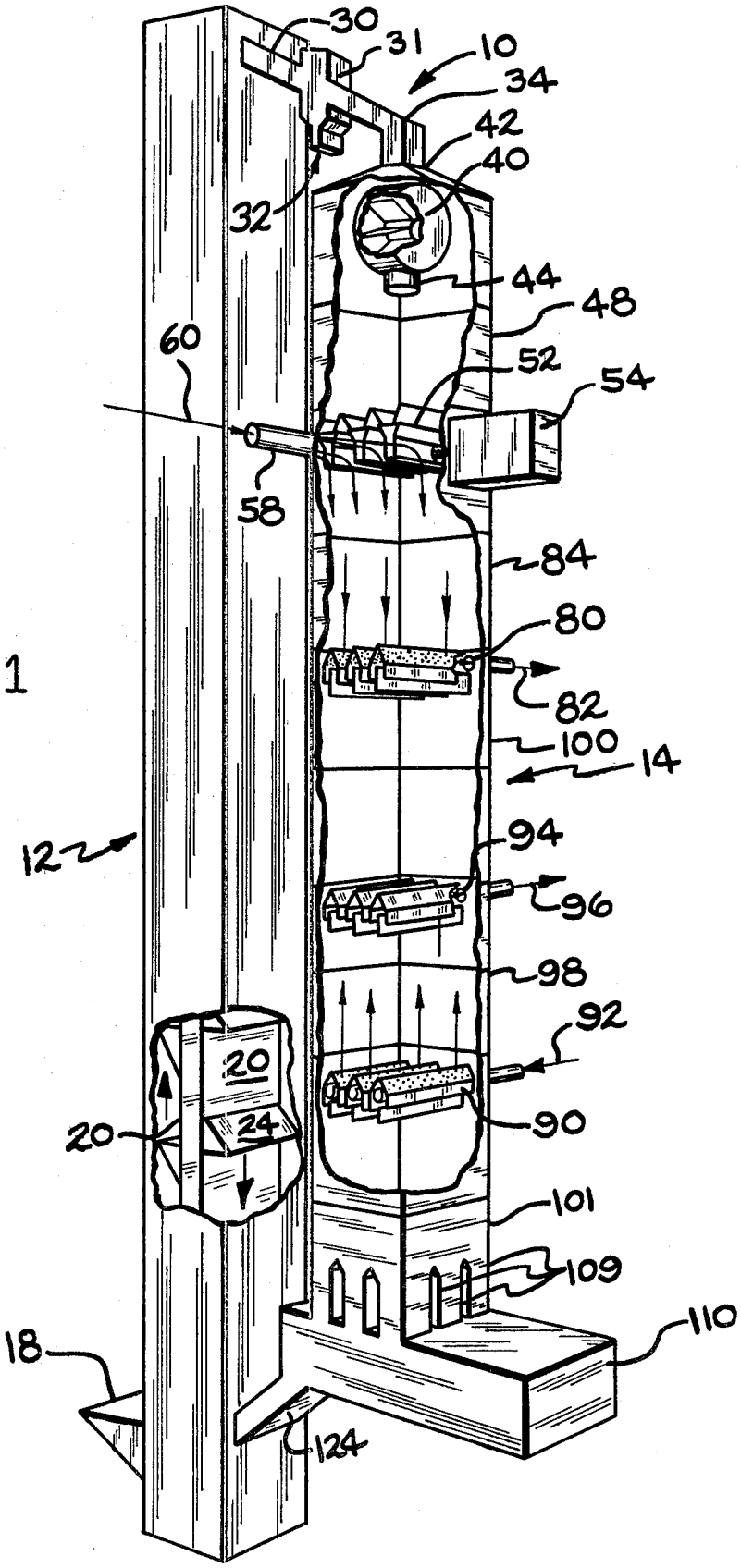
FIG. 1 is a perspective view of the particulate material drying apparatus with sections broken away to show details of the apparatus.
Figure 2:
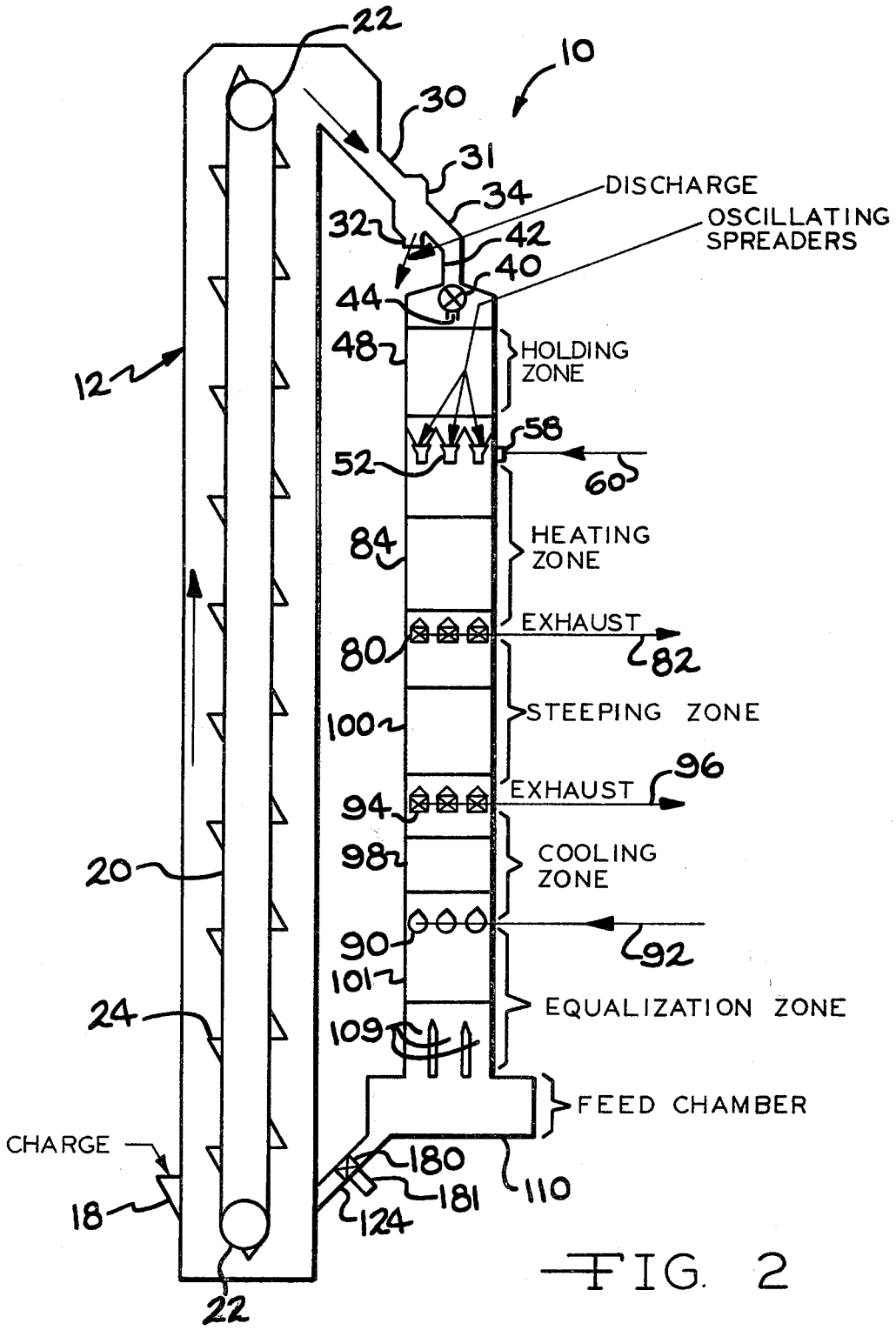
FIG. 2 is a schematic view of the drying apparatus of FIG. 1.

In FIGS. 1 and 2 there is shown a dryer 10 that is used to dry particulate material. The dryer comprises a supply chamber 12 and a drying chamber 14. A charging chute 18 is used to supply the particulate material to the interior of the supply chamber 12. A conveyor means 20 is positioned in the supply chamber and extends along substantially the entire longitudinal length of the supply chamber. Conveyor means is supported by and passes around rolls 22 to form an endless belt type of conveyor. In practice, it has been found that a bucket type of conveyor having buckets 24 attached to the surface of the conveyor means will work very satisfactorily.

Positioned at one end of the supply chamber is a discharge chute 30 that connects the supply chamber with valve means 31. The valve means is connected to discharge opening 32 and to passageway 34. The discharge opening 32 is connected to a suitable discharge conduit (not shown) and the passageway 34 is connected to the drying chamber 14. Accordingly, the valve means 31 connects the discharge chute 30 with either the discharge opening 32 or the drying chamber 14.

A rotary valve 40 or other appropriate means, to restrict upward heated fluid movement is positioned in the drying chamber at the point where passageway 34 connects to the drying chamber. The rotary valve is adapted with an inlet aperture 42 that is in communication with the passageway 34 and a discharge aperture 44 that is in communication with a holding chamber 48. The rotary valve contains a plurality of vanes that define the individual compartments within the valve.

An oscillating spreader mechanism 52 and appropriate drive means 54 is positioned at one end of the holding chamber 48. The drive means is connected to the spreader mechanism by any suitable connection means. U.S. Pat. No. 3,645,006 discloses a spreader mechanism that would work suitably in the present invention. The spreader mechanism is the preferred means for distributing the particulate material to the drying chamber. However, it should be recognized that other distribution means can be utilized and that the invention is not limited to the above spreader mechanism.

The drying chamber 14 is adapted with an inlet 58 at the general location of the spreader mechanism 52. Inlet 58 can be connected to any appropriate heating fluid source 60. The drying chamber 14 contains a first fluid collection means 80 and a discharge opening 82 connected to the fluid collection means that passes through the sidewall of the drying chamber. The volume of the drying chamber located between the inlet 58 and the first fluid collection means 80 defines a heating zone or chamber 84. It should be noted that the discharge opening 82 can be connected to a suitable exhaust energy recirculation or reclamation means.

The drying chamber 14 is also adapted with a cooling fluid supply means 92 that is connected to a fluid distribution means 90 positioned within the interior of the chamber. A second fluid collection means 94 is positioned in the drying chamber, and the second fluid collection means is adapted with a discharge opening 96 that passes through the sidewall of the drying chamber. The volume of the drying chamber located between the second fluid distribution means 90 and the second fluid collection means 94 defines a cooling zone or chamber 98. In addition, the volume of the drying chamber located between the first fluid collection means 80 and the second fluid collection means 94 defines a steeping zone 100.

Although the steeping zone 100 has been shown, it should be noted that a steeping zone is note required in all applications of the invention. If the steeping zone 100 is deleted from the apparatus of the invention, the first and second fluid collection means could be combined into a single common fluid collection means.

At the end of the drying chamber 14 beneath the fluid distribution means 90 is an equalization zone 101. The equalization zone 101 connects to a feed chamber 110 by a multiplicity of conduits 109. The conduits are evenly distributed across the bottom cross-section of the equalization zone 101. The feed chamber 110 is adapted to draw equal quantities of particulate material from such conduits and thus effect a substantially uniform gravity flow of material through the drying chamber 14. The feed chamber contains appropriate means (not shown) to control the flow rate of the particulate material through the drying chamber 14. The outlet of the feed chamber 110 is adapted with a supply chute 124 that passes from the feed chamber to the supply chamber 12. A valve 180 can be positioned in the supply chute 124 to provide an additional position where the particulate material can be removed from the dryer. Normally a discharge chute 181 is connected to the valve 180 to facilitate the removal of the particulate material.

The operation of the particulate dryer will be more fully understood by again referring to FIGS. 1 and 2. A predetermined quantity of particulate material to be dried enters the supply chamber 12 through the charging chute 18, or enters the inlet aperture 42 directly from an external source. Enough particulater material is normally supplied to the dryer 10 to fill the drying chamber 14 with particulate material. When filling the dryer via the supply chamber 12, particulate material is introduced through chute 18. Buckets 24 on the conveyor means 20 travel in the direction generally shown by the arrows in FIGS. 1 and 2, and as these buckets pass around support roll 22 located in the bottom of the supply chamber they pick up the particulate material flowing therein through the supply chute 18. The particulate material is advanced in the buckets until the conveyor and buckets pass around upper support roll 22. As the buckets pass around upper support roll 22 the particulate material is discharged into the discharge chute 30.

The drying operation begins after the dryer is filled with the predetermined quantity of particulate material. The valve means 31 directs the particulate material into passageway 34, through inlet aperture 42 and into rotary valve 40. The rotary valve 40 rotates and discharges the particulate material through a discharge aperture 44 into holding zone or chamber 48. The rotary valve 40, or other appropriate device acts as a fluid lock which checks the flow of heated fluid entering the drying chamber 14 from flowing through passageway 34. The spreader mechanism 52 which is driven by drive means 54 distributes the particulate material from the holding zone into thin uniform layers or sheets and discharges the particulate material into the heating chamber 84.

As the particulate material passes through the spreader mechanism 52 heated fluid enters the drying chamber through inlet 58 and comes into contact with the thin uniformly distributed layers of particulate material discharged from the oscillating spreader mechanism. The heated fluid is supplied to the inlet 58 from an appropriate source at the desired temperature for drying the particulate material. The heated fluid travels in the same direction as the particulate material through the heating zone 84 of the drying chamber. The heated fluid heats and removes moisture from the particulate material as the particulate material passes through the heating zone. A typical residence time of particulate material in the heating zone of the drying chamber ranges from about 1.5 to about 5 minutes. Each exposure of the particulate material to the high temperature fluid in the heating zone typically raises the temperature of the particulate material from about 3° to about 15° F. This relatively short exposure to the heated fluid removes a small increment of moisture from the particulate material.

The temperature of the heated fluid, supplied through inlet 58, is reduced as the fluid picks up moisture in passing concurrently with the particulate material through the heating zone 84. The fluid and absorbed moisture is collected in the fluid collection means 80 and exhausted through discharge opening 82.

After the heated fluid has been exhausted through the discharge opening 82, the particulate material passes through steeping zone 100. In the steeping zone the particulate material advances without the introduction of heating or cooling fluid. During the passage through the steeping zone there is at least a partial equalization of the temperature and moisture content throughout the individual particles of the particulate material. The supply chamber 12, holding chamber 48 and equalization zone 101 can also act as steeping zones for the particulate material as little heating or cooling fluid is introduced into the particulate material within these zones. Thus, in these areas of the dryer 10 there can be additional equalization of the temperature and moisture content in the individual particles of the particulate material.

After passing through the steeping zone 100 the particulate material enters the cooling zone 98 of the drying chamber. Cooling fluid is supplied through fluid supply means 92 into fluid distribution means 90 where the cooling fluid is discharged into the cooling zone 98. The cooling fluid flows through the cooling zone in a direction that is opposite to the direction of flow of the particulate material. The temperature of the cooling fluid increases as the fluid removes moisture from and cools the particulate material. The cooling fluid plus moisture is collected at fluid collection means 94 and discharged through discharge opening 96. Because the cooling fluid flows in a direction opposite to the direction of travel of the particulate material through the drying chamber 14, the entering particulate material is contacted by the warmest cooling fluid in the vicinity of the fluid collection means 94. As the particulate material passes through the cooling zone it is contacted by increasingly cooler fluid until it reaches the fluid distribution means 90 where the particulate material will be exposed to the coolest fluid that is introduced into the cooling zone 98. The counterflow directions for the cooling fluid and particulate material reduce the thermal shock that the particulate material is subjected to by assuring gradual uniform cooling as the particulate material flows through the cooling zone. The cooling fluid flowing through the cooling zone 98 reduces the temperature of the particulate material therein by about 75% to about 100% of the increase in the temperature of the particulate material flowing through heating zone 84. Thus, the cooling fluid in the cooling zone effectively removes substantially the increase in the temperature of the particulate material as it passed through the heating zone.

In the initial pass of the particulate material through the dryer the cooling fluid can be shut off to eliminate the cooling step. The elimination of the cooling step on the initial pass through the dryer allows the particulate material to heat up to the desired temperature more rapidly. After the initial pass through the dryer the cooling fluid is normally supplied to the dryer to cool and dry the particulate material.

After leaving the cooling zone 98 the particulate material enters the equalization zone 101. The equalization zone 101 acts as another steeping zone and functions in substantially the same way as previously described steeping zone 100. Upon leaving the equalization zone the particulate material enters feeder chamber 110.

The particulate material passes through feeder chamber 110 at a selected flow rate and is deposited into the supply chute 124. The particulate material moves along supply chute 124 into the bottom of the supply chamber 12. The feeder 110 removes equal quantities of particulate material through multiple conduits 109 to effect an even flow of particulate material throughout the cross-section of drying chamber 14. Thus, the particles of the particulate material will have a substantially uniform residence or retention time in the drying chamber 14. In addition, the rate at which the feeder 110 removes the particulate material from the drying chamber controls the rate at which the particulate material moves through the drying chamber. Thus, the residence time for the particulate material in the drying chamber is controlled by the feeder 110. Varying the residence time of the particulate material in the drying chamber 14 varies the temperature of the particulate material and the rate at which the particulate material is dried. The temperature and drying rate of the particulate material are also influenced by the heating fluid temperature and heating and cooling fluid flow rates.

As the particulate material is supplied from the feed chamber 110 into the bottom of supply chamber 12, the particulate material is again picked up by the conveyor means 20 and cycled through the supply and drying chambers. Additional moisture is removed from the particulate material each time the particulate material is passed through the drying chamber until the particulate material is dried to the desired level. The particulate material can be removed from the dryer relatively warm to be finally cooled in a separate structure or it can be final cooled within the dryer after sufficient drying has occurred.

A sensing device can be positioned in the supply chute 124 or elsewhere in the dryer 10 to sense the moisture content of the particulate material. When the moisture content of the particulate material has been reduced to the desired level the sensing device can change the position of valve 31 so that the particulate material passes through the supply chamber into the discharge chute 30 and is discharged through discharge opening 32 by valve means 31, or discharged through chute 181 by valve 180. Thus, when the desired moisture content for the particulate material is reached, the particulate material can be removed from the supply and drying chambers. Once the particulate material has been removed a fresh charge or batch of particulate material can be supplied through charging chute 18, or supplied through inlet aperture 42, and the drying cycle reinitiated.

In a specific example of an actual test illustrating the operation of this invention, 780 wet bushels of shelled corn having a moisture content of 28.7% were dried to a moisture content of 13.2%. The dryer had a cross sectional area of 25 square feet and air heated to 602° F. was the heated fluid used to dry the corn. In this test the heating and cooling zones were constructed so that the corn was in the heating zone for 13% and in the cooling zone for 8% of the operating cycle of the dryer. During the first cycle the heating zone was supplied with about 2125 standard cubic feet per minute of heated air. The quantity of heated air supplied to the dryer remained substantially constant for all the heating cycles for the dryer. The cooling zone was not supplied with cooling air during the first cycle. The corn was heated from its incoming temperature of 78° F. to a temperature of 122° F. during the first cycle. The grain circulation rate during the first cycle was about 430 bushels per hour. During the second cycle the grain circulation rate was increased to about 830 bushels per hour and the cooling zone was supplied with about 525 standard cubic feet per minute of cooling air at an ambient temperature of about 70° F. During the second cycle the temperature of the corn was increased to 131° F. in the heating zone. During the remaining thirteen heating-cooling cycles the circulation rate was increased to about 1700 bushels per hour, the corn temperature increased to 141° F. in the heating zone. The cooling zone airflow remained about 525 standard cubic feet per minute and the cooling air reduced the corn temperature about 7° F. in the cooling zone. The elapsed time per cycle was about 25 minutes. During the sixteenth or last cycle the heated air was discontinued, about 880 standard cubic feet per minute of ambient air was utilized in the cooling zone to cool the corn, and the discharge rate of the corn was about 215 bushels per hour.

The moisture removal during the first and second cycles was 1.6 and 1.2% moisture, respectively; during the next 13 cycles the moisture decreased about 0.8% for each cycle. During the final cooling cycle about 2% moisture was removed from the corn. During the whole test the heating and cooling zone exhausts averaged about 72 and 79% saturation respectively, with the overall exhaust air at an average of about 134° F. The natural gas energy supplied to heat the drying air amounted to about 1358 Btu to remove one pound of water from the corn; none of the exhaust energy was reclaimed to reduce the natural gas energy input.

The high temperature air used to dry the corn is very efficient in removing moisture from the corn. The corn is exposed to the high temperature air for only a short period of time so that the temperature increase of the corn with each pass through the heating chamber is small.

As the corn passes through the cooling chamber, the cooling air removes additional moisture and cools the corn. It is important that the temperature of the corn be reduced in the cooling chamber to avoid the potentially damaging effects that can result from maintaining the corn at an elevated temperature. The cooling air reduces the temperature of the corn to approximately the temperature the corn was prior to entering the heating chamber. The temperature of the corn being recycled through the drying chamber 14 usually ranges from about 110° F. to about 140° F. as the corn enters the drying chamber. The temperature of the corn that is being recycled is dependent on the amount of cooling in the cooling zone 98 and the speed at which the corn is recycled through the dryer 10.

The corn is recycled through the dryer 10 until the predetermined moisture content is obtained. Then the corn is discharged from the dryer and a new batch of corn to be dried is supplied to the dryer.

The major factors affecting the amount of moisture removed from the corn during drying are: batch size, initial temperature and moisture content of the corn, final temperature and moisture content of the corn, heated air temperature, and ambient temperature. These factors, in conjunction with the net heating value of the fuel, can be used to calculate the units of energy that must be supplied to produce the heated air needed to remove the desired amount of moisture from the corn to be dried.

Figure 4:
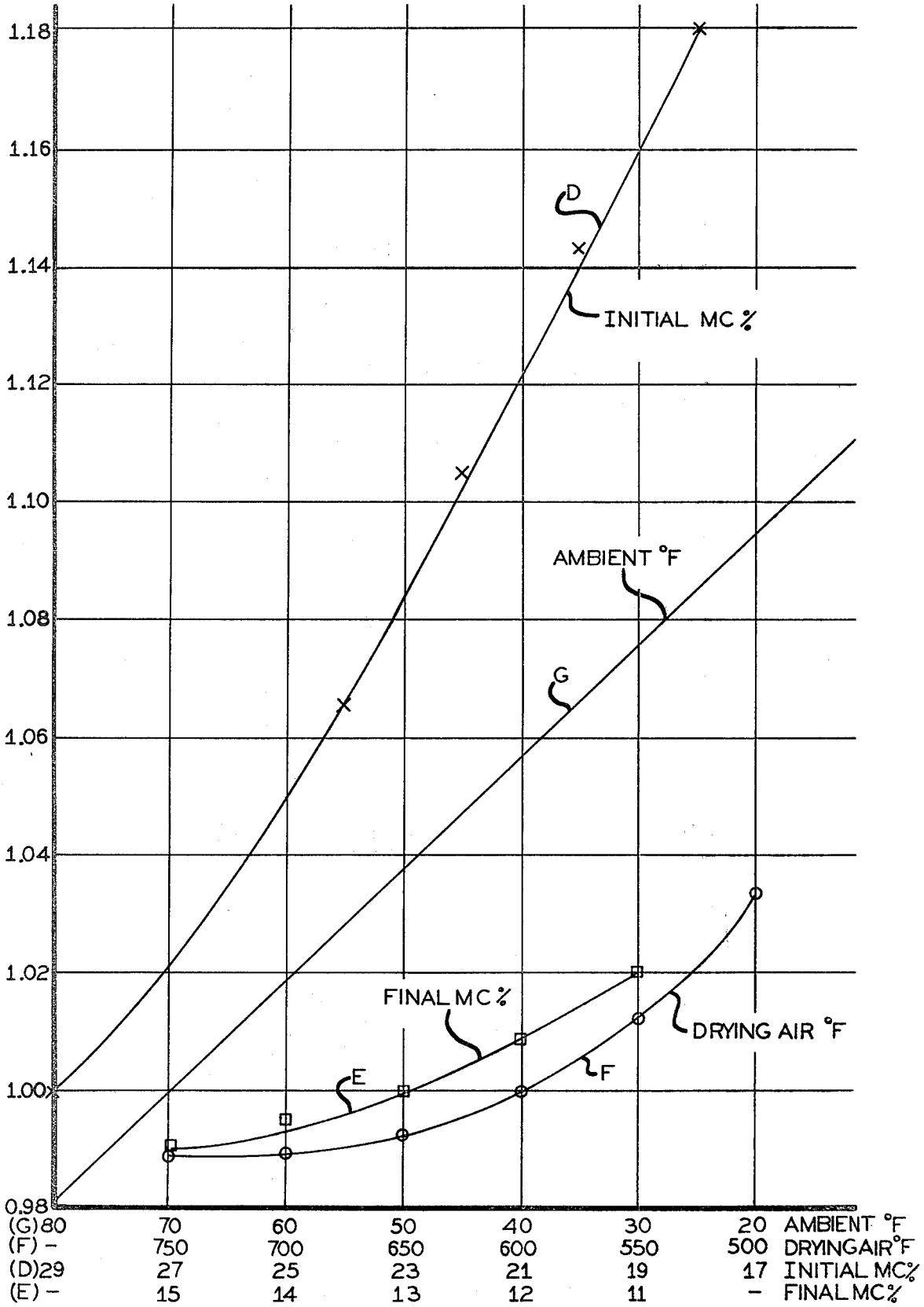
FIG. 4 is a graph of factors to be used in equation which determines units of fuel necessary to achieve desired final moisture content.

An equation that can be used as one way to calculate the units fuel required to heat the drying air is of the following form, using shelled corn for the example particulate material:

$$\text{Units Fuel} = \frac{1358\,(A \cdot B \cdot D \cdot E \cdot F \cdot G) + K}{L}$$

where 1358 is the Btu of fuel energy required to evaporate one pound of water, in the test installation, from the corn at the base conditions of 29% initial moisture content where the corn is dried to a 13% moisture content utilizing 600° F. heated air with the ambient air at 70° F. A represents the number of wet bushels of shelled corn to be dried having a weight of 56 pounds per wet bushel. B represents the amount of water to be removed per bushel. D is a factor related to the initial moisture content of the corn. E is a factor related to the final moisture content of the corn after drying. F is a factor related to the drying air temperature. G is a factor related to the ambient air temperature. K relates to the temperature difference of the corn entering and leaving the dryer. L is the net heating value of the fuel utilized to heat the drying air. The constant, 1358, and the factors D,E,F,G vary with different installations and are dependent on heat losses through the boundaries of the dryer. If frozen corn is supplied to the dryer additional energy is required to dry the corn. The quantity of additional energy required when drying frozen corn can be determined by experimentation. The D,E,F and G factors for the test dryer are shown in a graph in FIG. 4 for a range of conditions encountered in about 30 tests of the invention. The value of K is determined by multiplying together the final batch weight (A(56-B)), specific heat of the dried product and the temperature difference of the product entering and leaving the dryer (grain temperature out minus grain temperature in). If the grain temperature out is lower than the grain temperature in the value of K is negative and reduces the total units of fuel required since the grain is supplying energy for drying. The value of K will also be zero when the grain temperature entering and leaving the dryer are the same. The above formula and factors were determined experimentally and are believed to be true. However, in actual use additional testing and modifications may be necessary to properly calculate the fuel required to obtain the desired moisture content for the particulate material.

Following is an example of how the equation can be used to determine the amount of natural gas (at standard temperature and pressure) needed to dry 800 bushels of shelled corn. The corn has an initial temperature of 45° F. an initial moisture content of 26% and the ambient air temperature is 30° F. The corn will be dried to a 15% moisture content by 700° F. heated air and the corn will have a final temperature of 80° F. The values of A,B,-D,E,F,G,K and L are 800, 7.25, 1.035, 0.99, 0.99, 1.075, 651105 and 900 respectively. Therefore, applying the equation above, the fuel required to dry the grain will be 10,627 cubic feet of natural gas.

Accordingly, burning a predetermined quantity of fuel to heat the drying fluid can be a practical way to determine when the desired moisture content has been achieved in a particulate material. Once the calculated energy input has been supplied to heat the drying fluid the position of the valve 31 can be changed so that the particulate material is discharged from the dryer 10 through the discharge opening 32 or chute 181. Thus, the fuel input to heat the fluid provides a method of determining when the desired moisture content for the particulate material has been achieved.

It should be noted that the particulate material can be cooled in the dryer before being discharged or the particulate material can be cooled in a separate vessel. In the event it is deemed desirable to accomplish the final cooling step in another vessel, the particulate material can be discharged after burning a predetermined quantity of fuel based upon the equation given wherein the factor K is known for that vessel. This makes practical the combining of the described recirculating dryer with a cooling vessel in order to eliminate the cooling time in the drying vessel and thus increase the drying capacity of the drying vessel. This mode of operation would be more capital conserving for large high capacity installations than cooling in the drying vessel.

Figure 3:
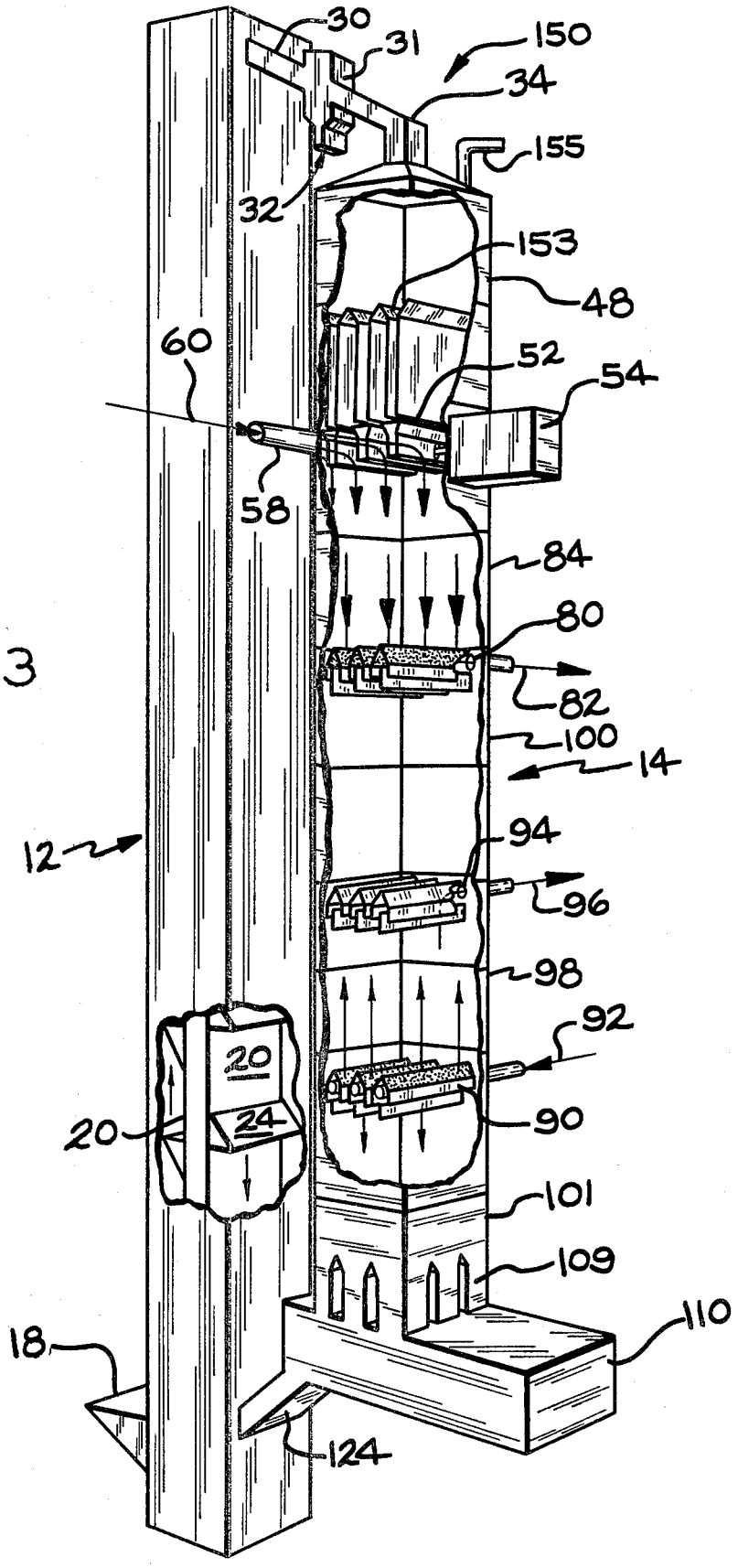
FIG. 3 is a perspective view of another embodiment of the particulate material drying apparatus with sections broken away to show details of the apparatus.

FIG. 3 shows another embodiment of a dryer utilizing the principles of the present invention. In this embodiment a dryer 150 is shown having the same general configuration and method of operation as the previously discussed dryer 10. However, there is a modification on this embodiment in the area where the particulate material passes from the supply chamber 12 into the drying chamber 14. The rotary valve has been removed from the passageway 34 in this embodiment. The oscillating spreaders 52 receive particulate material through passagways 153 having sufficient constriction and particulate material depth above the spreaders 52 to provide resistance to upward air movement by an amount proportional to the ratio of the cross sectional areas of the passageways 153 and the drying zone 84. In addition, a vent 155 has been placed in the drying chamber 14 at approximately the location where the passageway 34 enters the drying chamber. The vent 155 connects the drying chamber with the atmosphere. In this mode of operation the supply chamber 12 and holding zone 48 are essentially at atmospheric pressure. In the mode of operation which included the rotary valve 40 the supply chamber 12 was essentially at the pressure of the cooling fluid entering supply means 92 and the holding zone 48 was essentially at the pressure of the heated air entering supply means 58.

In operation the particulate material is supplied to the discharge chute 30, passes through a valve means 31 and enters the passageway 34 as previously described. The particulate material is discharged into the holding zone 48 and then flows through passageways 153 into the drying chamber 14. The particulate material passes through the drying chamber in the manner previously described. However, since there is no longer a rotary valve or other means to serve as a fluid lock in the passageway 34 and a vent 155 has been provided in the top of the drying chamber 14 a small portion of the hot fluid entering the drying chamber through inlet 58 flows in a direction opposite to the movement of the particulate material and passes into the holding zone 48. In most applications from about 1% to about 5% of the heated fluid supplied through inlet 58 flows in a direction opposite to the direction of advancement of the particulate material. The cross sectional area of the passageways 153 can be fixed by design to establish the quantity of heated fluid that flows in a direction opposite to the direction of advancement of the particulate material. Thus, this heated fluid moves in a counterflow direction into the holding zone 48 and acts to preheat and dry, to some extent, the particulate material located in the holding zone 48. The heated fluid flowing into the holding zone is discharged through the vent 155 located in the top of the drying chamber 14. In this embodiment the drying capacity is increased, within limits, due to the particulate material preheating and drying, prior to entering the heating zone 84, which effectively increase the size of the heating zone.

In the cooling zone 98 the major portion of the cooling fluid entering through the supply means 92 flows in a direction opposite the direction of the particulate material flow. A small portion of the cooling fluid can be fixed by design, in the same manner as described above to flow in the direction of the particulate material. Normally from about 1% to about 5% of the cooling fluid flows with the particulate material into the equalization zone 101. The cooling fluid passes with the particulate material through the equalization zone 101, into the feeder 110, through the supply chamber 12, and to the atmosphere through vent 155. Thus, this cooling fluid will cool and dry, to some extent, the particulate material flowing through the dryer. In this embodiment the drying capacity will be increased, within limits, due to the particulate material cooling and drying, prior to entering the holding zone 48.

An improved fuel efficiency is exhibited by the invention over prior art dryers because of the process to which the particulate material is exposed. The surface moisture of individual particles is removed by the intermittent exposure of the particulate material to the drying fluids; between exposures the moisture content tends to equalize through the individual particles, thus replenishing the surface moisture of the particulate material. Moisture on or near the surface of the particulate material is easier to remove from the particulate material. The moisture equalization and replenishment of surface moisture accomplished in the dryer of this invention reduces the energy required to remove moisture from the particulate material. In addition, the drying fluid temperatures utilized in the invention can be much higher than in prior art dryers, while at the same time preserving particulate material quality. These higher temperatures permit higher drying efficiencies because of thermodynamic considerations. The drying rate and drying efficiencies for the dryer are stable over a wider range of operating conditions and for a wider drying range than with prior art dryers.

Because of stabilized drying rates and fuel efficiencies over a wide range of particulate material moisture contents and ambient conditions, the desired moisture reduction is predictably related to fuel consumption. This is not true for most prior art dryers.

The high temperatures in the present dryer also reduce the significance of the ambient humidity and temperature on the effectiveness of the dryer. Prior art lower temperature dryers are significantly more sensitive to the ambient humidity and temperature. Accordingly, weather conditions could significantly alter the performance of these prior art dryers. The high temperatures utilized in the dryer of this invention substantially reduce the effects of ambient humidity and temperature on the efficiency of the dryer. The high temperature and moisture equalization present in the dryer also allows the dryer to efficiently dry particulate material having a relatively low moisture content.

Because of the high temperatures and moisture equalization utilized in this dryer significantly less drying fluid per unit volume of particulate material is required to dry the particulate material than in most prior art dryers. The drying fluid is also exhausted in a concentrated region in the dryer and this facilitates the location of pollution control equipment to clean the drying fluid utilized in the dryer. The pollution control equipment can also frequently be reduced in size as the volume of drying fluid required to dry the particulate material is usually less than that required in prior art dryers. Most pollution control equipment is sized to handle a volume of fluid flowing through the equipment and the concentration of pollutants in the fluid is generally of little consequence.

The process utilized by this invention results in improved product quality. Tests conducted simultaneously with prior art dryers indicate that corn dried by this invention has higher test weight, fewer stress cracks, and less breakage during handling than corn dried in a prior art dryers. Reducing the breakage during handling has the added benefits of less dust generation and explosion hazard. Reducing breakage also enhances the value of the dried product because of less screenings. Since the product temperature can be controlled during drying by this invention the seed germination of grain products can be maintained at the desired level.

The chance of a fire hazard is reduced by the dryer of this invention. All burnable particulates are contained in a single enclosed vessel which is designed so that particulates are not subjected to spontaneously induced drafts. If a fire is detected it can be extinguished before growing to alarming proportions by stopping the introduction of heating and cooling fluid and continuing recirculation of the particulate material until the burning embers are broken up and cooled. In prior art dryers the burnable particultes are contained in verticle shafts where thermal currents can spread fire rapidly and the fires must be extinguished with water. It is often difficult to reach the location of the combustion area in these prior art dryers. Such dryer fires expose the dryer, contents, surrounding structures and plant operating personnel to significant risk.

Having described the invention in detail and with reference to the drawings, it will be understood that such specifications are given only for the sake of explanation. There are modifications and substitutes, other than those cited, which can be made without departing from the scope of the invention as defined by the following claims.

What I claim is:

1. Method of drying particulate material comprising:

filing an enclosed chamber with a batch of particulate material to be dried;

passing the batch of particulate material through the enclosed chamber;

introducing a heated fluid into at least one portion of the enclosed chamber defining a heating zone to heat and absorb moisture from the particulate material, whereby the heated fluid absorbs a portion of the moisture to be removed from the particulate material as the particulate material moves though the heating zone;

introducing a heated fluid into at least one portion of the enclosed chamber defining a cooling zone to cool and absorb moisture from the heated particulate material whereby the cooling fluid absorbs a portion of the moisture to be removed from the particulate material as the particulate material moves through the cooling zone; and continuously recirculating the particulate material of the batch through the enclosed chamber to progressively remove moisture from the particulate material, the particulate material being recirculated through the chamber until the desired degree of drying is achieved in substantially the entire batch of particulate material.

2. The method of claim 1 in which the heating fluid and cooling fluid are simultaneously introduced into the enclosed chamber.

3. The method of claim 1 in which the major portion of the heated fluid introduced into the heating zone travels in the same direction as the particulate material through the enclosed chamber.

4. The method of claim 1 in which the particulate material is spread into thin uniform layers as the particulate material passes into the heating zone to obtain a substantially uniform exposure of the individual particles of the particulate material to the heated fluid.

5. The method of claim 1 in which the particulate material flows uniformly through the heating and cooling zones of the enclosed chamber whereby the particulate material has a substantially uniform residence time in the heating and cooling zones of the enclosed chamber.

6. The method of claim 1 in which a predetermined portion of the heated fluid introduced into the heating zone travels in a direction opposite to the direction of advancement of the particulate material through the chamber.

7. The method of claim 1 in which the major portion of the cooling fluid introduced into the cooling zone travels in a direction opposite to the direction of advancement of the particulate material through the chamber.

8. The method of claim 1 in which a predetermined portion of the cooling fluid introduced into the cooling zone travels in the same direction as the particulate material through the chamber.

9. Method of drying particulate material comprising:

filing an enclosed chamber with a batch of particulate material to be dried;

passing the batch of particulate material through the enclosed chamber;

introducing a heated fluid into a portion of the enclosed chamber defining a heating zone to heat and absorb moisture from the particulate material, substantially all the heated fluid traveling in the same direction as the particulate material through the enclosed chamber, whereby the heated fluid absorbs a portion of the moisture to be removed from the particulate material as the particulate material moves through the heating zone;

introducing a cooling fluid into a portion of the enclosed chamber defining a cooling zone to cool and absorb moisture from the heated particulate material, substantially all the cooling fluid traveling in a direction opposite to the direction of travel of the particulate material through the enclosed chamber, whereby the cooling fluid absorbs a portion of the moisture to be removed from the particulate material as the particulate material moves through the cooling zone; and continuously recirculating the particulate material of the batch through the enclosed chamber to progressively remove moisture from the particulate material, the particulate material being recirculated through the chamber until the desired degree of drying is achieved in substantially the entire batch of particulate material.

10. The method of claim 9 in which the heated fluid is air and the heated air can be introduced into the enclosed chamber at a temperature exceeding the ignition temperature of the particulate material being dried.

11. The method of claim 9 in which the temperature of the particulate material being dried is raised from about 3° to about 15° F. by each exposure to the heating fluids in the enclosed chamber.

12. The method of claim 9 in which the temperature of the particulate material being dried is lowered from about 3° to about 15° F. by each exposure to the cooling fluid in the enclosed chamber.

13. The method of claim 9 in which the cooling fluid introduced into the enclosed chamber reduces the temperature of the heated particulate material from about 75% to 100% of the increase in the temperature of the particulate material produced in the heating zone.

14. The method of claim 9 in which the heated particulate material passes through at least one steeping zone located in the enclosed chamber, the steeping zone acting to at least partially equalize the temperature and moisture content throughout the individual particles of the particulate material.

15. The method of claim 14 in which the particulate material passes through a steeping zone located between the heating zone and the cooling zone in the enclosed chamber.

16. The method of claim 9 in which the moisture content of the particulate material is measured during the recirculation of the particulate material and when the desired level of dryness is achieved the particulate material is discharged from the enclosed chamber.

17. The method of claim 9 in which a predetermined quantity of fuel is burned to heat the fluid entering the heating zone to a predetermined temperature whereby the desired amount of moisture will be removed from the particulate material when said predetermined quantity of fuel has been burned.

18. The method of claim 9 in which said particulate material is cooled to a desired temperature after the desired degree of drying has been achieved.

19. The method of claim 18 in which the final cooling cycle is accomplished in a separate vessel.

20. The method of claim 9 in which the particulate material is spread into a thin uniform layer as the particulate material passes into the heating zone to obtain a substantially uniform exposure of the individual particles of the particulate material to the heated fluid, the layers of particulate material being substantially perpendicular to the direction of travel of the heated fluid in the chamber.

21. Apparatus for drying a batch of particulate material comprising:

a housing defining at least one enclosed chamber through which the batch of particulate material is passed;

means for filing the enclosed chamber with the batch of particulate material a heating zone in the chamber, the heating zone adapted for the introduction of a heated fluid therein;

means for supplying a heated fluid to the heating zone to heat and remove moisture from the particulate material, whereby the heated fluid absorbs a portion of the moisture to be removed from the particulate material as the particulate material moves through the heating zone;

a cooling zone in the chamber, the cooling zone adapted for the introduction of a cooling fluid therein;

means for supplying a cooling fluid to the cooling zone to cool and remove moisture from the particulate material, whereby the cooling fluid absorbs a portion of the moisture to be removed from the particulate material as the particulate material moves through the cooling zone; and means for continuously recirculating the particulate material through the enclosed chamber to progressively remove moisture from the particulate material, the particulate material being recirculated until the desired degree of dryness is achieved in substantially the entire batch of particulate material.

22. The apparatus of claim 21 wherein the heating zone and cooling zone are located in separate sections of the enclosed chamber.

23. The apparatus of claim 21 wherein the means for supplying the heated fluid to the heating zone causes the heated fluid to travel in the same direction as the particulate material through the heating zone.

24. The apparatus of claim 21 wherein the means for supplying the cooling fluid to the cooling zone causes the cooling fluid to travel in a direction opposite to the direction of advancement of the particulate material through the cooling zone.

25. The apparatus of claim 21 wherein at least one fluid collection means is positioned in the chamber to remove the heated fluid and cooling fluid from the chamber.

26. The apparatus of claim 21 wherein at least one spreader means is positioned in the enclosed chamber, the spreader means acting to deposit the particulate material into a thin uniform layer as the particulate material passes into the heating zone of the enclosed chamber.

27. The apparatus of claim 21 wherein a steeping zone is located in the enclosed chamber, the steeping zone acting to at least partially equalize the temperature and moisture content throughout the individual particles of the particulate material.

28. The apparatus of claim 27 wherein the steeping zone is located between the heating and cooling zones in the enclosed chamber.

29. The apparatus of claim 21 wherein a conveyor is used to transport the particulate material so that the particulate material can be recirculated through the enclosed chamber until the desired degree of dryness is achieved.

30. The apparatus of claim 21 wherein sensing means is positioned adjacent the conveyor means for recirculating the particulate material, said sensing means sensing the moisture content of the particulate material and indicating when the desired degree of dryness in the particulate material is achieved.

* * * * *

UNITED STATES PATENT AND TRADEMARK OFFICE

CERTIFICATE OF CORRECTION

PATENT NO. : 4,372,053

DATED : February 8, 1983

INVENTOR(S) : Robert J. Anderson and Glenn E. Hall

It is certified that error appears in the above—identified patent and that said Letters Patent is hereby corrected as shown below:

Claim 1, Line 45, "a heated fluid" should be --a cooling fluid--

Column 5, line 1, "Enough particulater" should be --Enough particulate--.

Signed and Sealed this

*Twenty-eighth* Day of *June 1983*

[SEAL]

*Attest:*

GERALD J. MOSSINGHOFF

*Attesting Officer*

*Commissioner of Patents and Trademarks*